United States Patent [19]

Neiger

[11] Patent Number: 4,704,656

[45] Date of Patent: Nov. 3, 1987

[54] FIBER OPTIC WIRING DEVICE CONTROL SYSTEM

[75] Inventor: Benjamin B. Neiger, Floral Park, N.Y.

[73] Assignee: Leviton Manufacturing Company, Inc., Little Neck, N.Y.

[21] Appl. No.: 926,924

[22] Filed: Oct. 27, 1986

[51] Int. Cl.[4] ..... H01H 47/24

[52] U.S. Cl. ..... 361/173; 307/117; 350/486

[58] Field of Search ..... 323/353, 902; 361/173, 361/174; 350/486; 307/117, 140; 250/221, 234

[56] References Cited

U.S. PATENT DOCUMENTS

| | | | |
|---|---|---|---|
| 3,087,066 | 4/1963 | Keogh, Jr. | 361/173 X |
| 3,931,514 | 1/1976 | Patterson | 307/117 X |
| 4,324,981 | 4/1982 | Miller | 250/551 |
| 4,352,046 | 9/1982 | Tigner et al. | 307/117 X |

FOREIGN PATENT DOCUMENTS

| | | | |
|---|---|---|---|
| 0165131 | 12/1985 | European Pat. Off. | 307/117 |

*Primary Examiner*—Patrick R. Salce
*Assistant Examiner*—Marc S. Hoff
*Attorney, Agent, or Firm*—Paul J. Sutton

[57] ABSTRACT

The present invention teaches a control system wherein fiber optics controls the functioning of one or more types of wiring devices, such as a wall receptacle. With the use of the present invention, a relatively safer system is provided for use in wet, hospital, explosive and other environments, and which is capable of surface mounting. Switch and load supply assemblies are interconnected by fiber optic means for transmitting reflected signals from a movable mirror to a photocell-influenced relay circuit.

6 Claims, 1 Drawing Figure

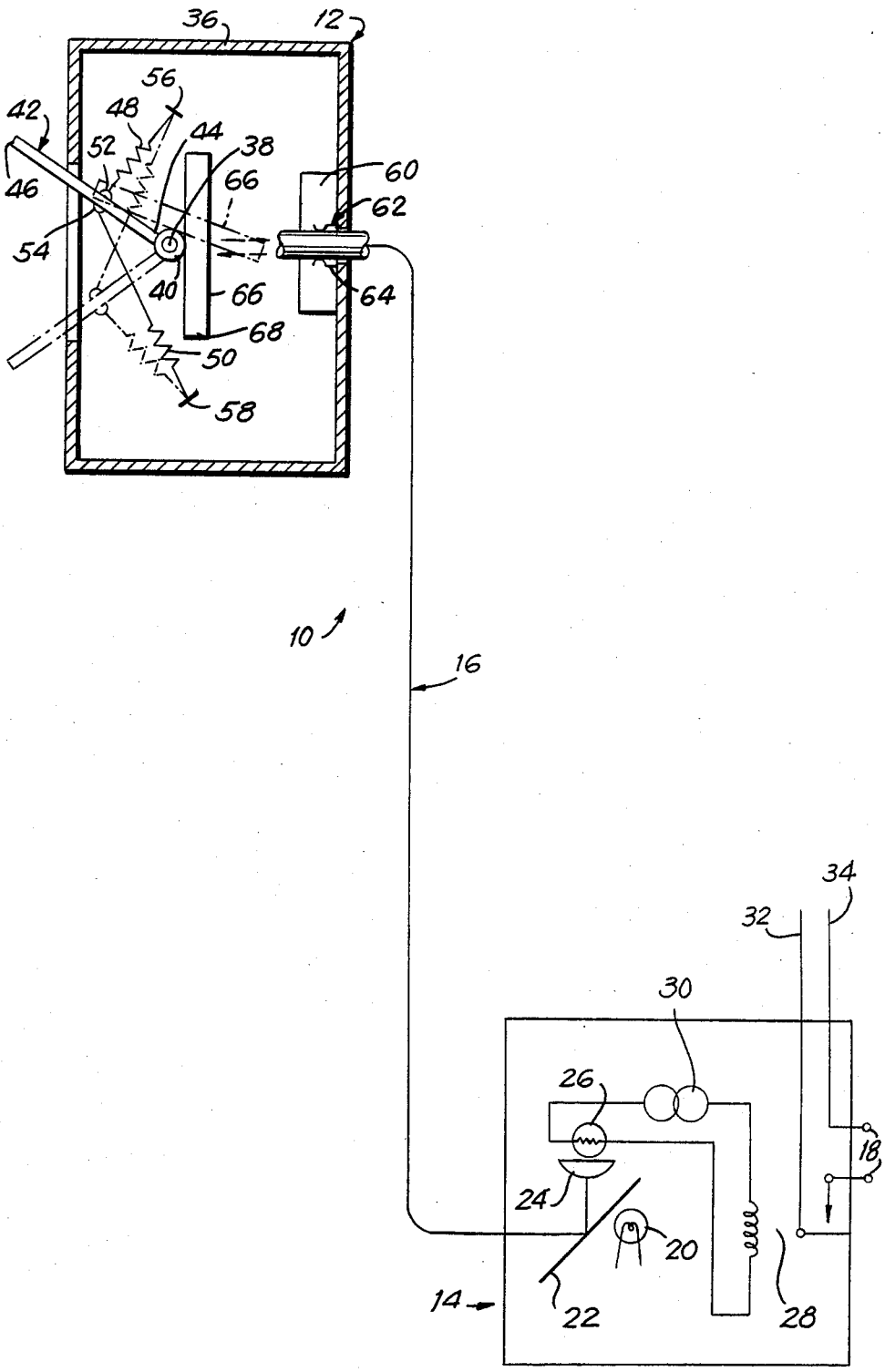
36
12
56
42
48
44
38
52
60
46
66
62
54
40
66
64
68
50
58
10
16
34
32
30
26
18
24
20
14
22
28

FIBER OPTIC WIRING DEVICE CONTROL SYSTEM

The present invention relates to the field of wiring devices, and more particularly to an improved and safer system for controlling wiring devices such as receptacles or lamp sockets, or the like.

A need exists for a system for controlling power to an electrical load, such as an electrical wall receptacle, where possibility of sparks, fire, shock or electrocution is avoided in any predetermined environment, such as applications near or under water, or within explosive environments, by way of example. A need also exists for such a system, wherein the use of electrical wiring may be eliminated, and where corrosion is avoided.

Conventional or prior art electrical switches in use today are of constructions which require copper or conductive electrical wires from the load to the switch, wherein arcing normally plays a role in the life of electrical contacts within the wiring device. This arcing presents an environment wherein fire or explosion within a combustive atmosphere is a danger. In addition, the arcing generates noise in radios, televisions, instruments, or the like. Loose electrical connections due to faulty installation can cause overheating and possible fire and, absent relatively large and unattractive conduits, the wires are not normally surface mounted, such as over a wall or ceiling surface. Such wiring also carries with it a measurable voltage drop where relatively long lengths of wire are involved.

It is an object of the present invention to meet these needs, and to provide a system for controlling one or more wiring devices, or the like.

It is another object of the present invention to provide such a system which is capable of mounting upon the surface of a wall and ceiling, rather than within same.

It is a further object of this invention to provide such a system wherein a completely safe environment is made available to the user, and wherein there is virtually no electricity at the novel switch assembly according to the present invention, thereby eliminating any danger of shock or electrocution, even near or under water.

Yet another object of this invention is to provide such a system, wherein switching of electrical wiring devices is accomplished without electrical wires, thereby eliminating sparks, heat at the switch, fire and other related hazards.

A further object of the present invention is to provide such a system, wherein a novel switching assembly is independent of the voltage of the devices being controlled, such that the same switch assembly may turn on and off devices which carry thousands of volts and amperes or only millivolts and micro-amperes.

Other objects of the present invention will become apparent to the reader from the present specification, read in conjunction with the claims and drawing, wherein similar reference characters denote similar elements, and wherein:

The drawing is a schematic representation and partial fragmentary sectional elevational view of the system according to the present invention.

This invention meets the foregoing objectives and solves the problems associated with conventional devices by providing a system for controlling wiring devices, or the like, comprising a load supply assembly and a switch assembly, these assemblies being interconnected by a fiber optic cable. The load supply assembly includes a support housing, a source of light located within this housing, a photoelectric sensor and relay means responsive to the photoelectric sensor for closing a current carrying circuit. The switch assembly includes a switch housing, a reflective surface such as a mirror movably supported within the switch housing, and a toggle mechanism for moving the mirror between on and off positions. Light generated by the source of light is transmitted from the load supply assembly through the fiber optic cable to the switch assembly wherein, with the reflective surface of mirror in the on position, this transmitted light is reflected back through a fiber optic cable to the photoelectric sensor which, in turn, causes power to be supplied to the load.

Referring now in more detail to the drawing, a system 10 according to the present invention includes a switch assembly 12 and a load supply assembly 14 coupled or interconnected by a fiber optic cable 16. Load supply assembly 14 supplies power "out" to an electrical load (not shown) via terminals 18, the electrical load being any one or more of a variety of wiring devices including, without limitation, a wall receptacle or a lamp socket. A relatively small source of light 20, such as a light emitting diode (LED), neon lamp or incandescent lamp, is supported within load supply assembly 14 opposite a relatively lower side of light transmitting (two way) mirror 22 supported at a 45 degree angle. A lens 24 is located between mirror 22 and a photoelectric cell 26, which itself is in series with a relay 28 supplied with power through supply 30. Phase and neutral lines 32 and 34, respectively, are shown leading to load supply assembly 14.

Switch assembly 12 includes a housing 36 which supports a pivot rod 38 which, in turn, supports a hub 40 for pivotal movement between an "on" position shown in full lines in the drawing, and an "off" position shown in phantom lines within the same drawing. This pivotal movement is facilitated by means of a lever 42 connected to hub 40 at an inner end 44. The opposite outer end 46 of lever 42 protrudes from housing 36 to a position within reach of the hand of a user. In a preferred embodiment of the present invention, a pair of springs 48 and 50 are anchored to lever 42 substantially mid-length at anchor points 52 and 54, respectively, and to their respective housing anchor points 56 and 58, such that the position of lever 42 is controlled and maintained. In this way, an over-center type control of lever 42 may be realized or simply an arrangement where lever 42 occupies either an "on" position as shown in full lines in the drawing, or an "off" position as shown in phantom or broken lines.

Means for holding the ends of fiber optic cable 16 to and within housing 36 include a retainer plate 60 within which a resilient cable retainer clip 62 is situated, with resilient fingers 64 able to engage and hold cable 16 in the position shown, with its end held substantially normal or perpendicular with respect to the surface 66 of a mirror 68 integral at its midsection with hub 40.

Fiber optic cable 16 may be of a single light-transmitting conduit, or may consist of two or more such light-transmitting paths. What is required according to the present invention is that light be capable of transmission between the load supply assembly 14 to the switch assembly 12 and back to the load supply assembly, as will be more fully understood from the following description of the operation of the present invention.

In operation, light emitted from source 20 reaches the end of fiber optic cable 16 at the load supply assembly and is transmitted through cable 16 to its opposite end held by fingers 64 of clip 62. This light "hits" surface 66 of mirror 68 and is reflected back to cable 16, which transmits the reflected light to the reflective surface of mirror 22. Mirror 22 reflects this light being returned from switch assembly 12 toward lens 24, which focuses and, optionally, magnifies same. The light from lens 24 is focused upon photoelectric cell 26 which becomes conductive, thereby permitting current from relay power supply 30 to energize relay 28 which, in turn, causes a switching "on" of power from lines 32 and 34 to the output terminals 18 of the load supply assembly 14.

Upon the user moving lever 42 from the "on" position shown in full lines in the drawing to the "off" position shown in broken or phantom lines, light carried from source 20 to switch assembly 12 by cable 16 is not reflected back to the load supply assembly and, thus, without a supply of light to photoelectric cell 26, the cell becomes non-conductive, causing an opening of relay 28 with a resulting "breaking" of the supply of power to terminals 18 and any device electrically connected thereto, such as lighting. Cell 26 may be a device such as a selenium cell, a cadmium sulfide cell, a photovoltaic silicone cell or other photo-sensitive semiconductor.

Thus, the user may toggle switch assembly 12 for the desired result—without the need for electrically conductive wires, arcing, heat, fires, electric shock, voltage drops, etc. While the relay 28 has been illustrated in the form of an electro-mechanical relay, it is contemplated by the present invention for this device 28 to be a solenoid or a solid state device, such as a transistor, silicone controlled rectifier, triac, FET, or other suitable means.

The present invention further contemplates the ability of the user to surface mount cable 16 upon the ceiling or walls of rooms.

The embodiments of the present invention illustrated and described are presented merely as examples of the invention. Other forms, embodiments and examples of this invention coming within the proper scope of the appended claims will readily suggest themselves to those skilled in the art.

What is claimed is:

1. A system for controlling a wiring device, or the like, comprising, in combination:
- a load supply assembly, and
- a switch assembly,
- said load supply assembly including
  - a support housing,
  - a source of light disposed within said housing,
  - a photoelectric sensor,
  - relay means response to said photoelectric sensor for closing a current carrying circuit,
- said switch assembly including
  - a switch housing,
  - a reflective surface movably supported by said switch housing,
  - means for moving said reflective surface between on and off positions,
- said control system further comprising fiber optic means communicating with both said load supply and switch assemblies for transmitting light from said source to said reflective surface and back to said load supply assembly for controlling said current carrying circuit.

2. A system according to claim 1, wherein said load supply assembly further includes a mirror capable of transmitting light therethrough disposed between said source of light and said fiber optic means.

3. A system according to claim 2, wherein said mirror is capable of permitting light from said source to reach said fiber optic means and of reflecting light transmitted back from said switch assembly to said load supply assembly towards said photoelectric sensor.

4. A system according to claim 3, further comprising a lens for influencing light from said mirror before it reaches said photoelectric sensor.

5. A system according to claim 1, wherein said load supply assembly includes a relay and a supply of power for said relay.

6. A system according to claim 5, wherein said load supply assembly further includes power output conductors capable of supplying power when said reflective surface is in said on position.

* * * * *